US005090878A

United States Patent [19]

Haller

[11] Patent Number: 5,090,878

[45] Date of Patent: Feb. 25, 1992

[54] NON-CIRCULAR ORBITING SCROLL FOR OPTIMIZING AXIAL COMPLIANCY

[75] Inventor: David K. Haller, North Syracuse, N.Y.

[73] Assignee: Carrier Corporation, Syracuse, N.Y.

[21] Appl. No.: 640,765

[22] Filed: Jan. 14, 1991

[51] Int. Cl.[5] ..... F01C 1/04

[52] U.S. Cl. ..... 418/1; 418/55.2; 418/55.5

[58] Field of Search ..... 418/1, 55.2, 55.5; 29/888.022

[56] References Cited

U.S. PATENT DOCUMENTS 4,304,535 12/1981 Terauchi ..... 418/55.2

4,609,334 9/1986 Muir et al. ..... 418/55.2

FOREIGN PATENT DOCUMENTS 59-37289 2/1984 Japan ..... 418/55.2

*Primary Examiner*—John J. Vrablik

[57] ABSTRACT

The axial forces acting upon the orbiting scroll of a scroll compressor during operation produce a resultant force which requires a varying, crank angle dependent radius for dynamic equilibrium. The flat plate or floor portion of the orbiting scroll is provided with a varying radius to provide sufficient radius to be acted on by the resultant force. In a preferred embodiment, the radius is only increased beyond the nominal radius for the angular extent necessary and a diametrically located angular extent of reduced radius is provided to make room for other components and/or to reduce friction.

6 Claims, 11 Drawing Sheets

NON-CIRCULAR ORBITING SCROLL FOR OPTIMIZING AXIAL COMPLIANCY

BACKGROUND OF THE INVENTION

In a scroll device one scroll member orbits with respect to a second scroll member which is typically fixed. Each scroll member has a flat plate or floor portion and an axially extending wrap of a spiral configuration. Ideally, the tips of the wraps of each scroll coact with the floor of the other scroll and the flanks of the wraps of the scrolls coact with each other to define a plurality of trapped volumes or chambers in the shape of lunettes. The lunettes are each approximately 360° in extent and are generally symmetrical but are asymmetrical with respect to the axis of the fixed scroll. The ends of the lunettes, which are defined by the points of tangency or contact between the flanks, are transient in that they are continuously moving towards the center of the wraps as the trapped volumes or chambers continue to reduce in size until they are exposed to the outlet port.

During the compression process, a number of forces come into effect. The gas being compressed acts against the scroll members tending to separate them both radially and axially but because one scroll member is fixed, any movement is limited to the orbiting scroll. Since the axis of the orbiting scroll is located eccentrically with respect to the axis of rotation of the crankshaft, the trapped volumes or chambers are located eccentrically with respect to the axis of the fixed scroll as are the forces associated therewith. Also, there are inertia and friction forces inherent in the driving of the orbiting scroll. To offset these forces a fluid pressure bias has been applied to the back side of the orbiting scroll to offset the axial component of the gas forces, with the net force being the clamping or reaction force, and the bearing supporting the hub of the orbiting scroll has been located so as to minimize the turning moment of the tangential component of the gas forces.

Because leakage must be minimized to have an acceptable device, the fluid pressure bias applied to the back side of the orbiting scroll must exceed the opposing forces so that the plate of the orbiting scroll is held in engagement with the opposing structure of the fixed scroll by a positive clamping force. The excess clamping or reaction force needed to maintain the desired sealing over the entire operating envelope and the friction forces resulting therefrom puts an extra load on the motor and accelerates wear.

SUMMARY OF THE INVENTION

Because the trapped volumes or chambers are eccentrically located with respect to the axis of the crankshaft and fixed scroll, their gas forces vary cyclically with the crank angle. This cyclic variation means that the radial location of the reaction force also changes with the crank angle. So, rather than requiring a uniform radial extent as exemplified by a circular scroll plate, there are localized requirements for greater and lesser radial extents. By reducing the radial extent of the scroll in one location, there is a removal of material, a reduction in friction due to the reduced contact area and an increase in the available space. Where the radial extent is increased the reverse is true but there is a resultant greater stability of the orbiting scroll.

It is an object of this invention to provide an orbiting scroll having increased stability and reduced overall-/average clamping or reaction force.

It is another object of this invention to reduce part contact wear and friction in scroll compressors by reducing the overall clamping or reaction force.

It is a further object of this invention to optimize the scroll floor of an axially compliant orbiting scroll for spatial reasons. These objects, and others as will become apparent hereinafter, are accomplished by the present invention.

Basically, the axial forces acting upon the orbiting scroll of a scroll compressor during operation produce a resultant or clamping force. The resultant force requires a radius in order to attain dynamic equilibrium and this radius varies with the crank angle. The flat plate or floor portion of the orbiting scroll is configured to be acted on by the resultant force by having the radius of the scroll plate vary in the same manner as the variation in the radius of the location of the resultant force for the entire operating envelope considered.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
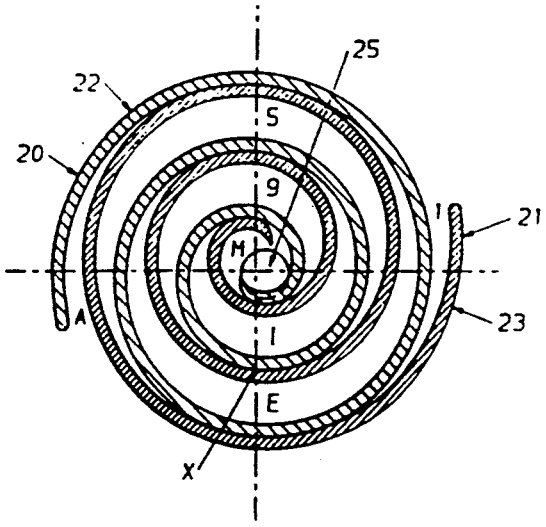
FIGS. 1–4 are schematic views sequentially illustrating the relative positions of the wraps at 90° crank angle intervals of orbit.
Figure 2:
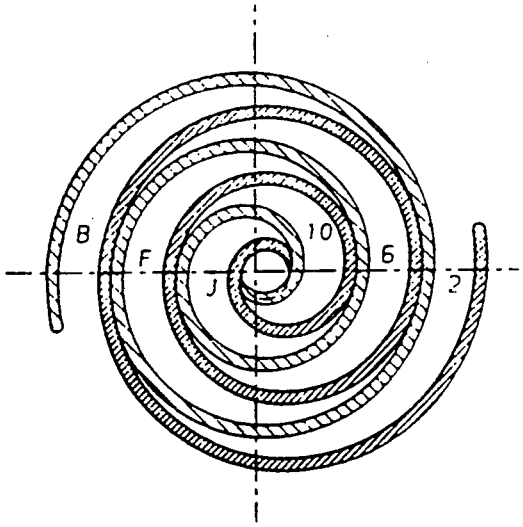
Figure 4:
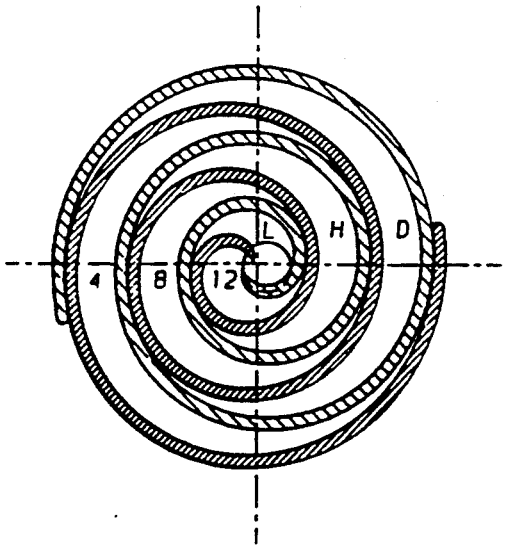
Figure 3:
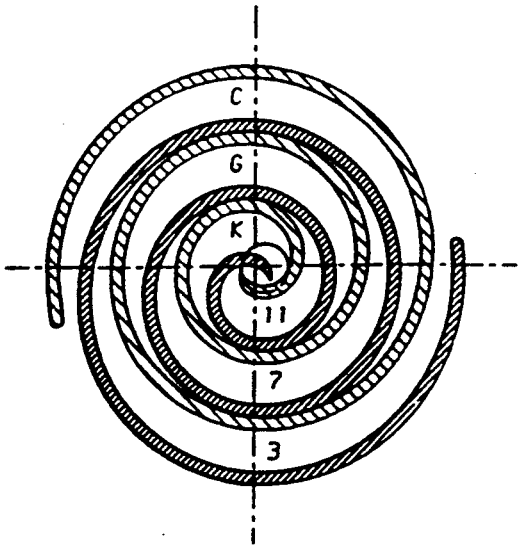

In FIGS. 1–4, the numeral 20 generally indicates the fixed scroll having a wrap 22 and the numeral 21 generally indicates the orbiting scroll having a wrap 23. The chambers labeled A–M and 1–12 each serially show the suction, compression and discharge steps with chamber M being the common chamber formed at discharge or outlet 25 when the device is operated as a compressor. It will be noted that chambers 4–11 and D–K are each in the form of a helical crescent or lunette approximately 360° in extent with the two ends being points of line contact or minimum clearance between the scroll wraps. If, for example, point X in FIG. 1 represents the point of line contact or of minimum clearance separating chambers 5 and 9 it is obvious that there is a tendency for leakage at this point from the high pressure chamber 9 to the lower pressure chamber 5 and that any leakage represents a loss or inefficiency. To minimize the losses from leakage, it is conventionally necessary to maintain close tolerances, use a positive mechanical tip seal and to run at high speed and/or to provide a fluid pressure axial bias. Again referring to FIGS. 1-4, it will be noted that there is a symmetry in that chambers 1-12 correspond to chambers A-L with the difference being that they are on opposite sides of the wraps 22 and 23. However, it will be noted that the chambers 1-12 and A-L are not symmetrically located with respect to the axes of the fixed scroll represented by the intersection of the vertical and horizontal dashed lines in the outlet 25. Further, it should be noted that chambers A-C and 1-3 are at suction pressure so they do not contain pressurized gas acting against the scrolls 20 and 21 and tending to separate them. Chambers 4 and D are just at the start of the compression process so they are nominally at suction pressure and so do not contain pressurized gas tending to separate scrolls 20 and 21. So, chambers E-M and 5-12 are the only ones containing significantly pressurized gas tending to separate scrolls 20 and 21. Again referring to FIGS. 1-4 and noting that the chambers 1-12 and A-L are not symmetrically located with respect to the axes, it can be further noted that the centroids of these chambers will be eccentric to the axes, along with the gas forces associated therewith.

Figure 5:
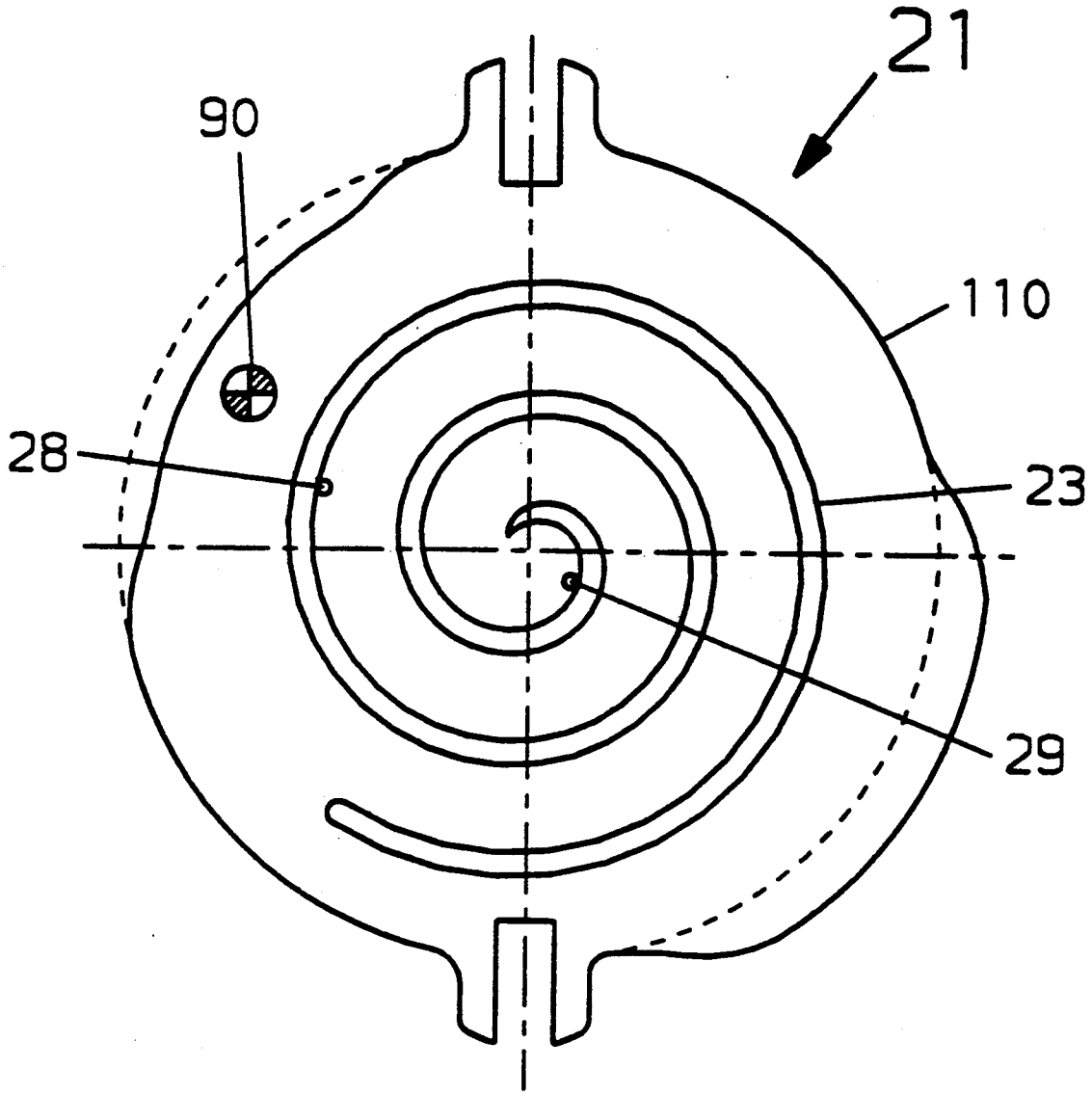
FIG. 5 is a top view of an orbiting scroll made according to the teachings of the present invention.

Referring now to FIG. 5, it will be noted that the outer configuration of orbiting scroll 21 is at a varying distance from the axis represented by the intersection of the horizontal and vertical axes. Where the outline of a conventional circular orbiting scroll plate differs from the scroll plate 110 of the present invention, it is shown in dashed lines in FIG. 5 and the difference between the dashed and solid lines represents the material added or removed. To maintain the center of gravity of the orbiting scroll 21, a counterweight 90 and/or drilled holes (not illustrated) may be provided to offset the addition and loss of material necessary to configure the floor or plate 110 of the orbiting scroll 21.

Figure 6:
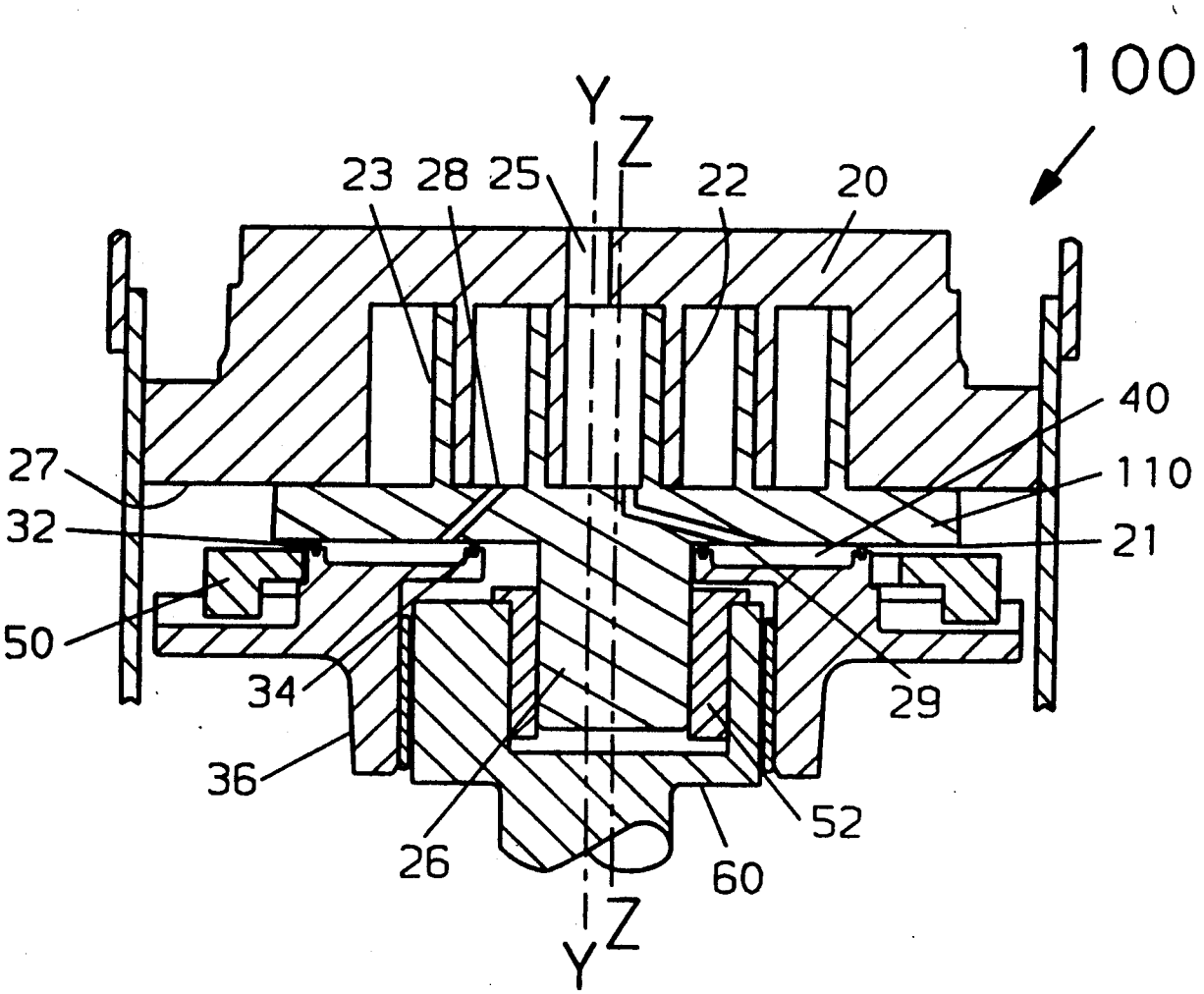
FIG. 6 is a vertical sectional view through the scrolls of a scroll compressor employing the present invention.

In FIG. 6, the numeral 100 generally designates a hermetic scroll compressor. Pressurized fluid, typically a blend of discharge and intermediate pressure, is supplied via bleed holes 28 and 29 to annular chamber 40 which is defined by the back of orbiting scroll 21, annular seals 32 and 34 and crankcase 36. The pressurized fluid in chamber 40 acts to keep orbiting scroll 21 in engagement with the fixed scroll 20, as illustrated. The area of chamber 40 engaging the back of orbiting scroll 21 and the pressure in chamber 40 determines the compliant force applied to orbiting scroll 21. Specifically the tips of wraps 22 and 23 will engage the floor of scrolls 21 and 20, respectively, and the outer portion of the floor or plate portion 110 of orbiting scroll 21 engages the outer surface 27 of the fixed scroll 20 due to the biasing effects of the pressure in chamber 40. As is conventional, orbiting scroll 21 is held to orbiting motion by Oldham coupling 50. Orbiting scroll 21 has a hub 26 which is received in bearing 52 and driven by crankshaft 60, as is conventional. Crankshaft 60 rotates about its axis Y—Y, which is also the axis of fixed scroll 20, and orbiting scroll 21, having axis Z—Z, orbits about axis Y—Y.

Figure 7:
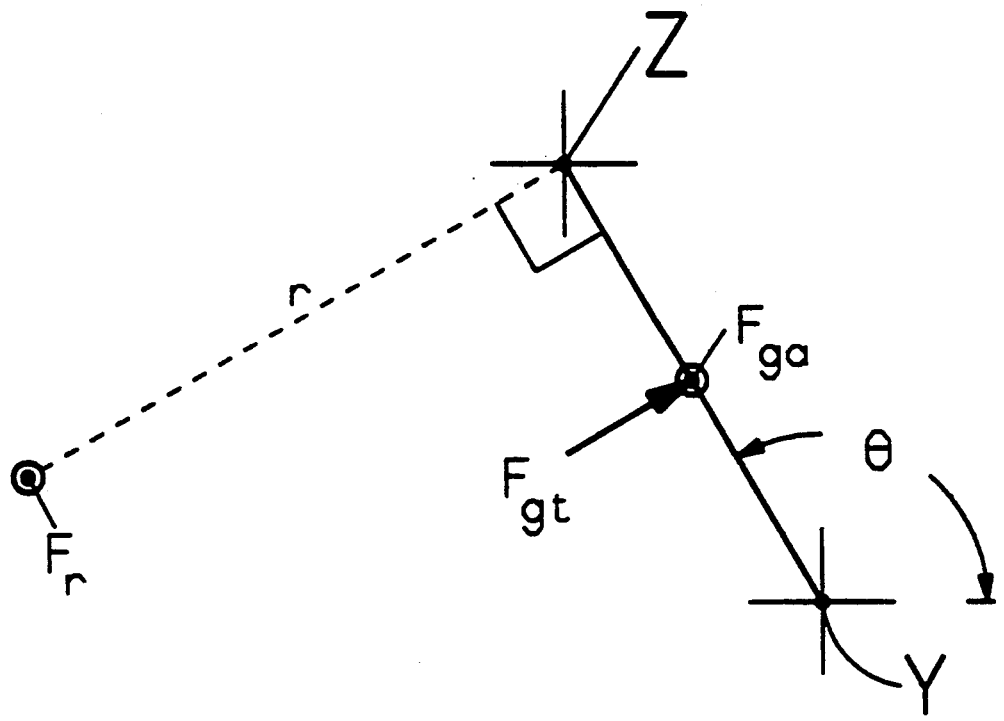
FIG. 7 is a horizontal view of the forces acting on the orbiting scroll.
Figure 8:
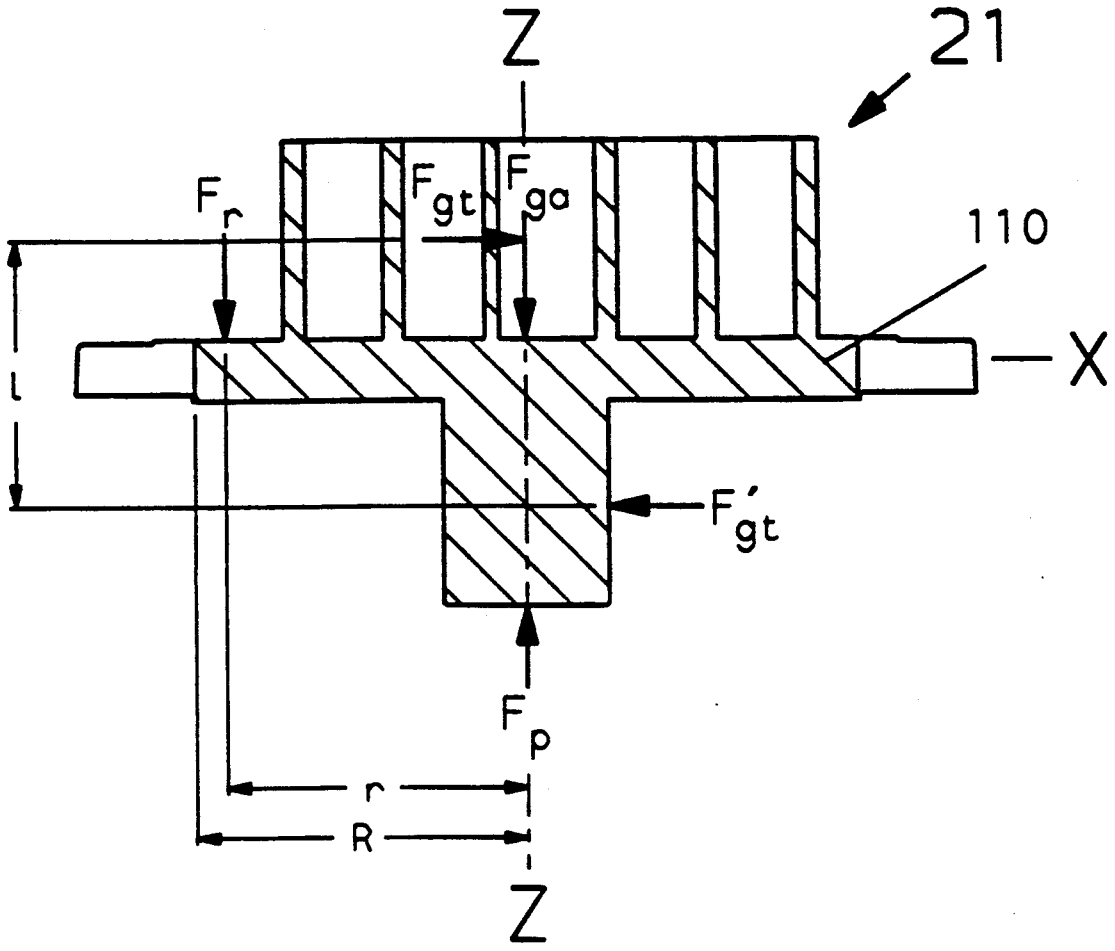
FIG. 8 is a vertical sectional view of the orbiting scroll of the present invention showing the forces acting thereon.

In FIG. 7, Y is the point representation of axis Y—Y of crankshaft 60 and fixed scroll 20 and Z is the point representation of axis Z—Z of the orbiting scroll 21. The distance between Y and Z is the throw of crankshaft 60 as well as the radius of orbit of orbiting scroll 21. The angle $\theta$ is the crank angle and is arbitrarily shown as measured from a horizontal reference line. The tangential gas force, $F_{gt}$, acts at a point mid-way between Y and Z and in a direction opposite to the direction of orbit. The axial gas force, $F_{ga}$, also acts at a point mid-way between Y and Z but in a direction parallel to axes Y—Y and Z—Z (into the paper). The reaction or clamping force, $F_r$, acts in a direction parallel to axes Y—Y and Z—Z (into the paper) and at a crank angle dependent radius, r, from point Z and the plane defined by Y—Y and Z—Z. The reaction force, $F_r$, results from the outer portion of the floor or plate portion 110 engaging the outer surface 27 of the fixed scroll 20 due to the biasing effects of the pressure in chamber 40. Referring now to FIG. 8, as noted, the reaction force, $F_r$, acts at a crank angle dependent radius, r. The gas forces have a tangential, $F_{gt}$, and an axial, $F_{ga}$, component. Pocket 40 is annular so that the axial compliant force, $F_p$, is axial generally along the vertical axis Z—Z of the orbiting scroll 21. The tangential gas force, $F_{gt}$, is assumed to be located at the center of the wrap height and is opposed by a bearing reaction force, $F'_{gt}$, supplied by the bearing 52 at an axial distance, l, from the location of force $F_{gt}$. The radius of the plate or floor 110 of orbiting scroll 21 is R and varies as illustrated in FIG. 5. Radius r also varies and is always less than or equal to R in a stable device.

Figure 9:
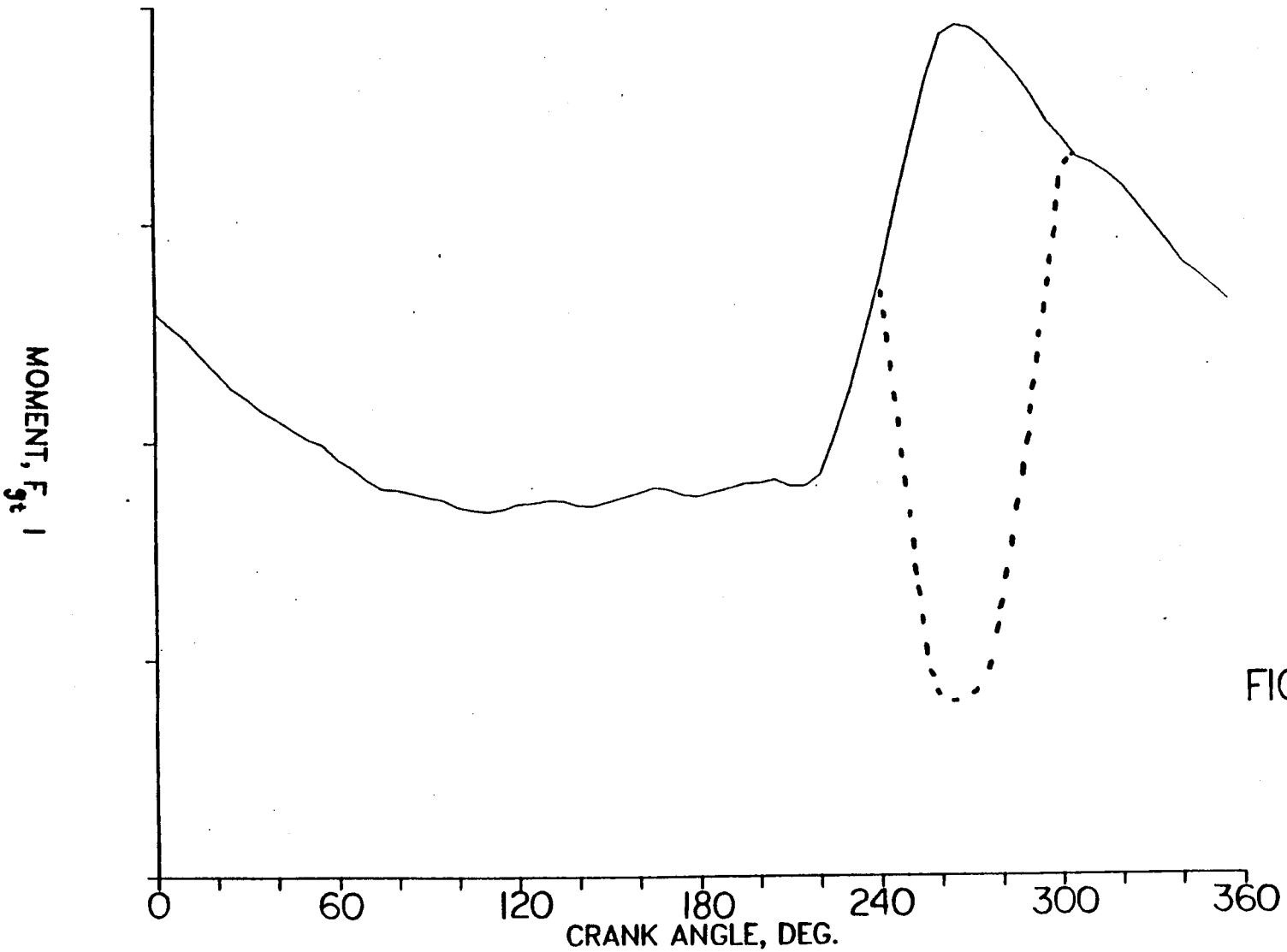
FIG. 9 is an exemplary plot of moment vs. crank angle.
Figure 10:
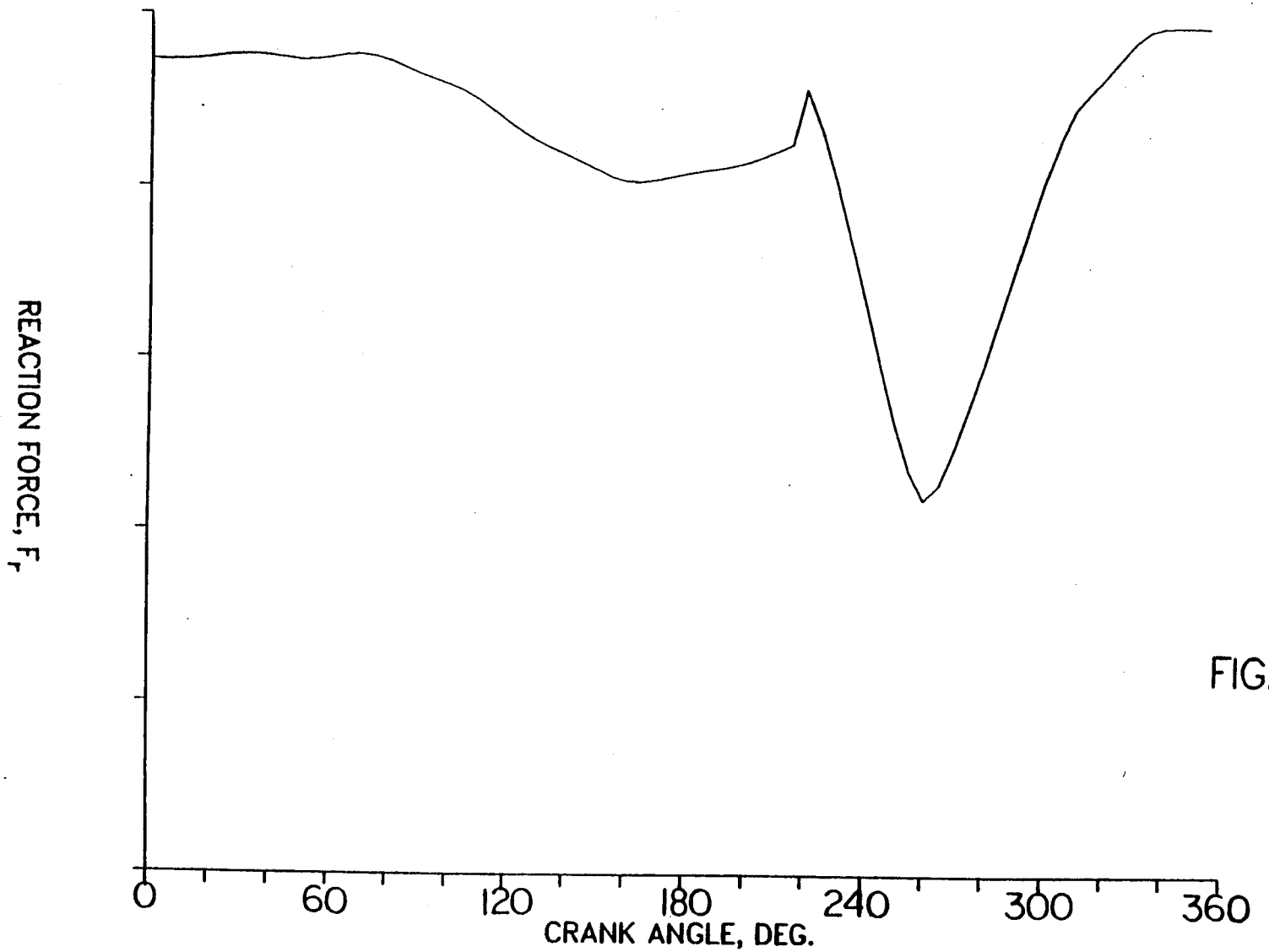
FIG. 10 is an exemplary plot of reaction force vs. crank angle.

For a scroll operating at any point in the operating envelope, a moment exists on the orbiting scroll. The moment is equal to $F_{gt}l$ and varies with the crank angle as illustrated in FIG. 9. $F_{gt}$ is an instantaneous value and l is minimized to the extent possible. Thus, the curve can be shifted vertically without changing its shape. The bearing reaction force, $F'_{gt}$, is assumed to be approximately equal to $F_{gt}$, but adding friction forces makes it greater and requires more motor watts. However, this moment must be counteracted at all times or the orbiting scroll will vibrate. The moment is counteracted by supplying an upward axial pressure (compliant) force, $F_p$, which holds the scrolls together plus leaves a net reaction force, $F_r$, which acts at radius r, creating the counteracting moment at all times. Referring now to FIG. 10, $F_p$ and therefore $F_r$ depend upon the area of and pressure in chamber 40. The pressure is dependent upon the location of the bleed holes 28 and 29 in orbiting scroll 21, as illustrated in FIG. 5, which supply pressure to chamber 40. The plots of the chamber pressure vs. crank angle in FIG. 11 for three operating envelope points show the pressures available during the entire compression process, which requires approximately 950° of crankshaft revolution. Thus, in FIG. 10, the curve for $F_r$, $(F_p - F_{ga})$, can be shifted up or down depending upon whether more or less force is desired. Increased $F_r$ also means more friction wattage.

Figure 12:
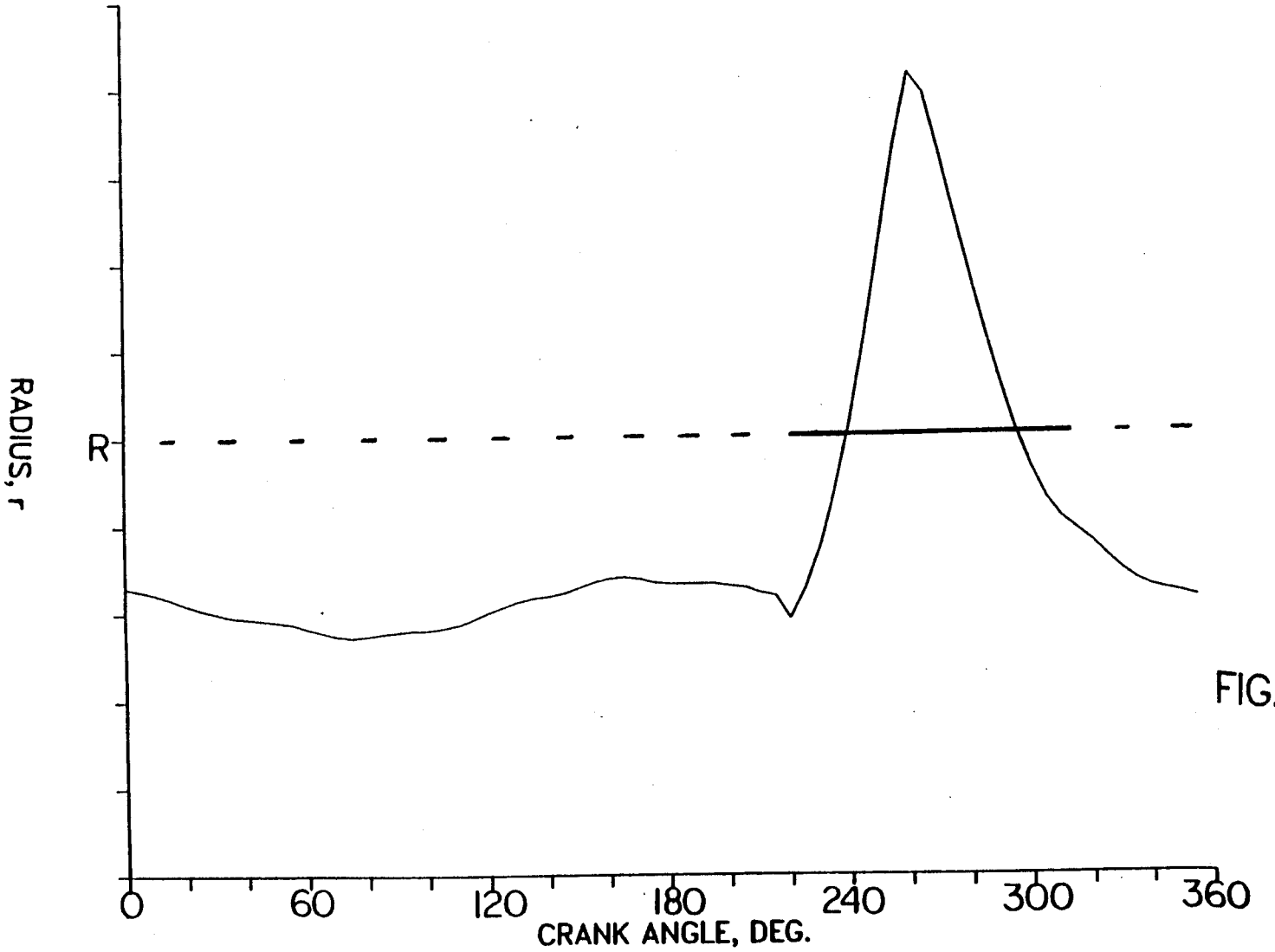
FIG. 12 is an exemplary plot of radius, r, vs. crank angle.
Figure 13:
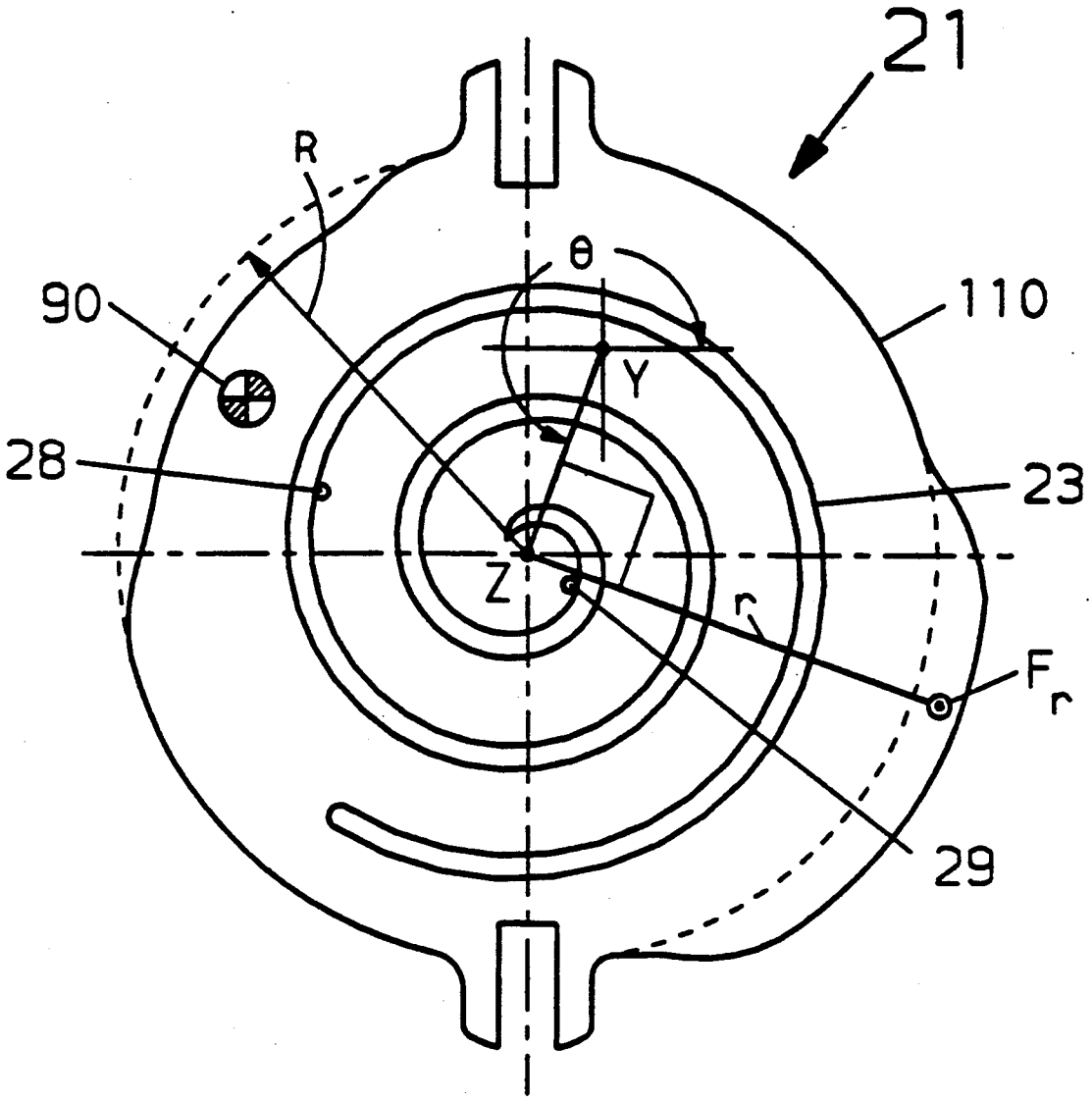
FIG. 13 is a superposition of FIG. 7 on FIG. 5.

Referring now to FIG. 12, we first assume a uniform radius, R, of the orbiting scroll 21 equal to 3.5 inches, the selected design radius of the plate 110 of orbiting scroll 21. Plotting r, the radius required to locate the necessary reaction force, $F_r$, we see that between a crank angle of 240° and 300° there is insufficient radius to multiply by $F_r$ values to counteract the moment since $r > 3.5$ inches. This is also illustrated in FIG. 13, where at a crank angle $\theta$ of approximately 260°, the radius r required to located $F_r$ falls outside the uniform radius of 3.5 inches indicated by the dashed lines; and Y, Z, $\theta$, and $F_r$ are as defined in FIG. 7. So, in the interval between a crank angle of 240° and 300° there will be a deficit moment which is illustrated by the dashed line in FIG. 9. The orbiting scroll 21 will vibrate under these conditions. Again referring to FIG. 12, it will be noted that between 0° and 220° and between 320° and 360° the required r is consistently less than the 3.5 inches provided.

As noted above, the location of bleed holes 28 and 29 and the area of chamber 40 can be changed to shift the curve of FIG. 10 to increased values of $F_r$ which would require smaller r values. However, this adds friction and motor wattage. Alternatively, we can add radius to the plate or floor 110 of orbiting scroll 21, as shown in FIGS. 5 and 13, to meet the increased radius requirements between crank angles of 240° to 300°. Also, as illustrated in FIGS. 5 and 13, the radius can be reduced at places where the larger radius is not required such as between 0° and 220° and between 320° and 360°, or, more typically, for balancing simplification, in places approximately 180° opposed to where radius was added.

Figure 11:
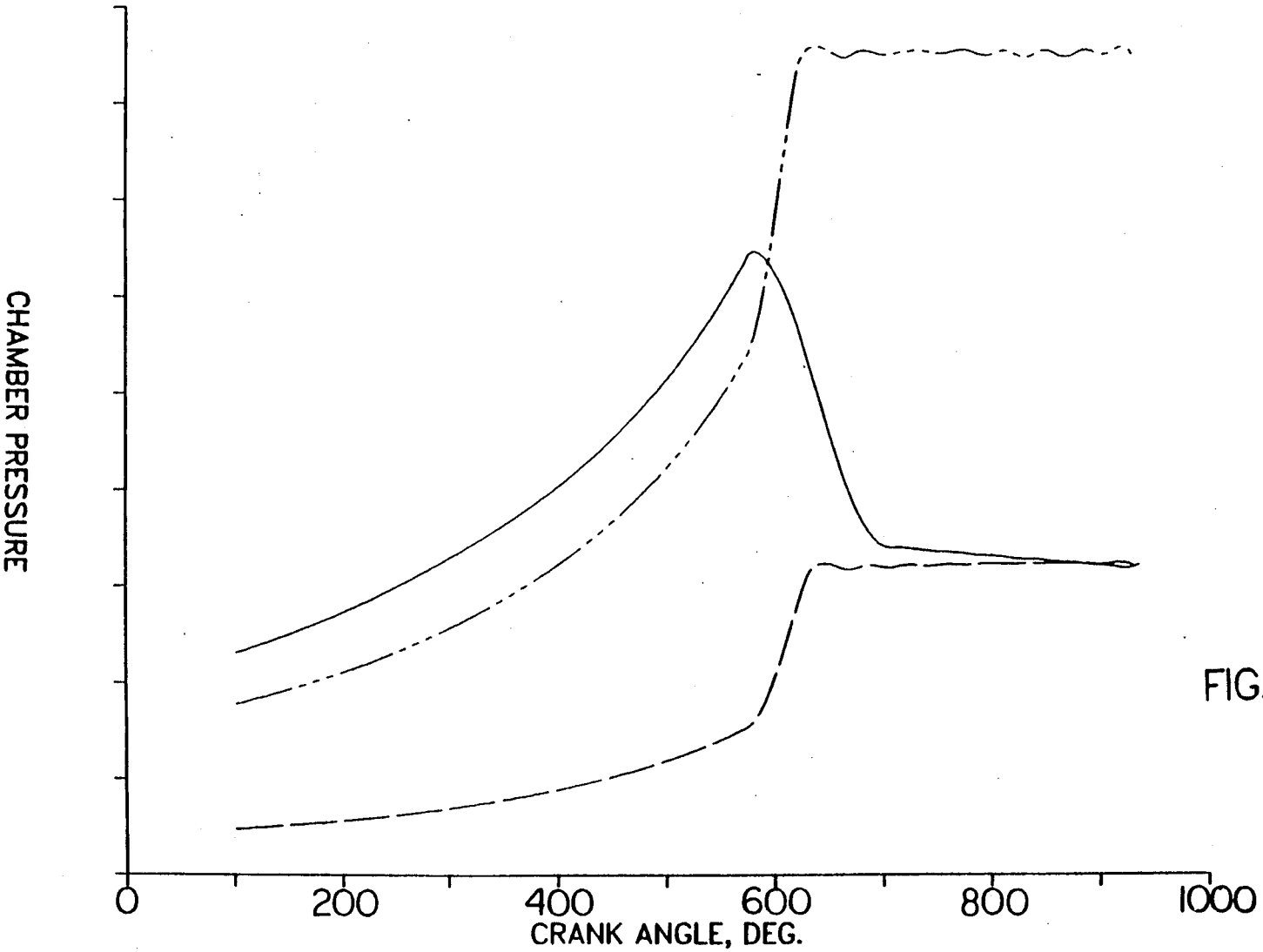
FIG. 11 is an exemplary plot of chamber pressure vs. crank angle for three different operating envelope points or conditions.

It is necessary to consider all of the extreme points of the compressor's intended operating envelope, as exemplified by the plots of FIG. 11, plus several rating points within the envelope. Then, a "best fit" of the orbiting scroll shape for a particular design can be obtained. The benefits are: (1) a lower $F_r$ curve (FIG. 10) for all design points; (2) reduced friction watts; and (3) additional space for other components where the material is removed.

Referring again to FIG. 8, all of the variables except 1 are time (crank angle) dependent. Inertia and friction forces are neglected and the following assumptions are made: (1) $F_{gt}$ and $F'_{gt}$ are essentially equal; (2) $F_p > F_{ga}$ at all times or the scroll 20 and 21 will separate; and (3) $F_p$ and $F_{ga}$ mostly act in a plane defined by axes Y—Y and Z—Z and generally parallel to the vertical axis/centerline of orbiting scroll 21 (axis Z—Z).

Since $F_{gt} \approx F'_{gt}$, $\Sigma F_x = 0$

For $\Sigma F_Z$ to equal 0, $F_p = F_r + F_{ga}$ or $F_r = F_p - F_{ga}$

For $\Sigma$Moments to equal 0, $F_{gt} l = F_r r$ $$r = (F_{gt} l)/F_r = (F_{gt} l)/(F_p - F_{ga})$$

Because $F_{gt}$, $F_p$ and $F_{ga}$ are each crank angle (time) dependent, the value of R necessary to locate the reaction force $F_r$ at radius r is also crank angle dependent. Stated, otherwise, R must be greater than r in order to properly locate the reaction force $F_r$ but beyond a safety factor, any excess of R over r: (1) produces undesirable friction forces and wear as described above; (2) wastes space; and (3) means that $F_p - F_{ga}$, or $F_r$, is too large therefore causing excessive friction. However, the final distribution of R depends upon analyzing all envelope points at which the device is intended to operate.

Starting with the design and/or calculated values of $F_{gt}$, $F_{ga}$ and $F_p$ at all crank angles for each intended operating condition of any axially-compliant scroll device, the shape of the orbiting scroll floor 110 can be optimized by first designing in a constant reference radius R such as the 3.5 inch radius indicated in FIG. 12. Considering all crank angles for each intended operating condition, material will be added or removed (i.e. R will be increased or decreased) accordingly as prescribed by the relationship $$r = (F_{gt} l)/(F_p - F_{ga})$$

Figure 14:
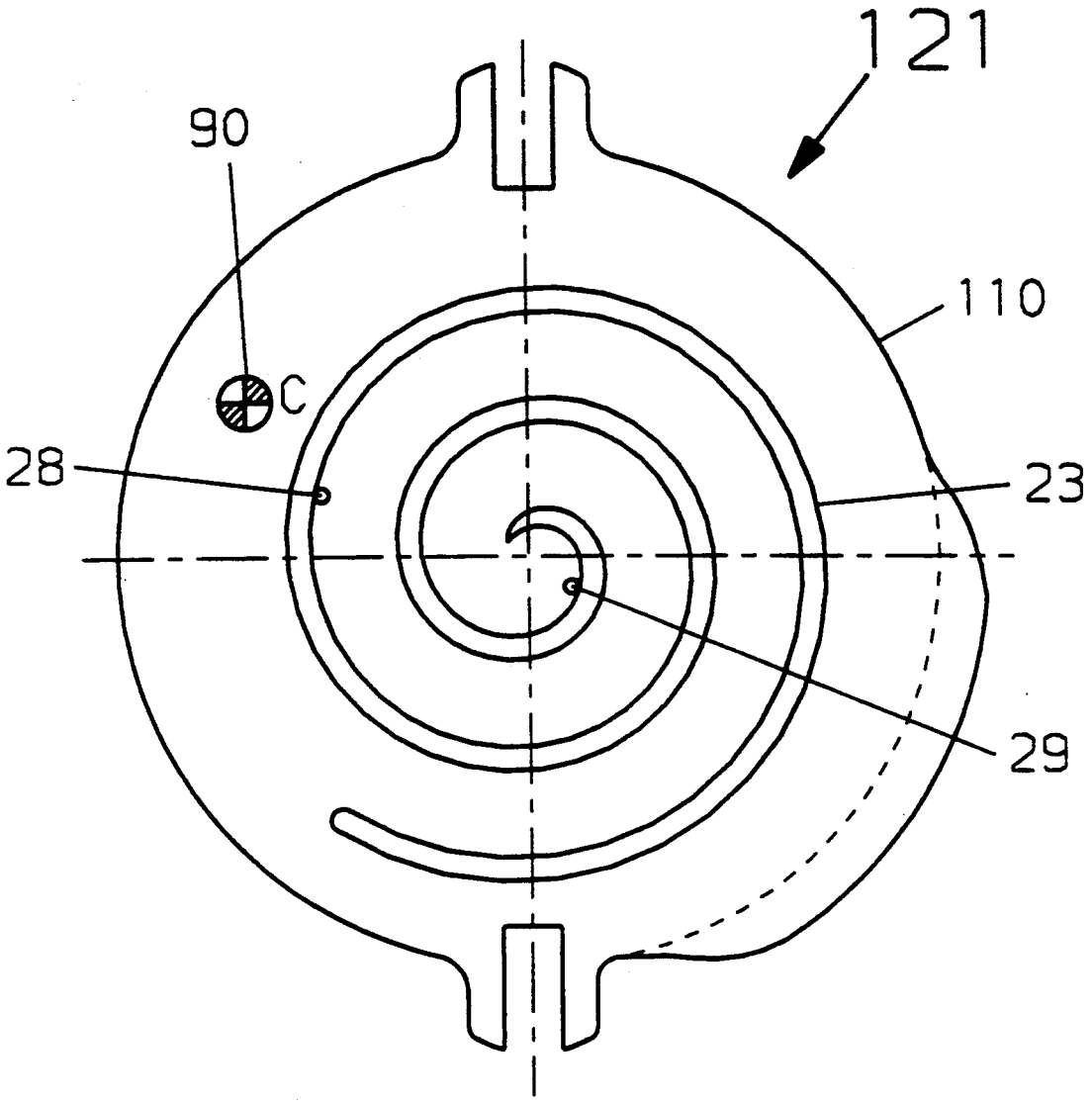
FIG. 14 is similar to FIG. 5 except that it only has an area of increased radius.

Additionally, a safety factor or distance, δ, is included so that $R - r \geqq \delta$ at all crank angles for each intended operating condition. The final configuration is, preferably, a smoothed curve. However, as noted in FIG. 12, r is generally constant except for the 220°-340° crank angles and only the 240°-300° range is greater than 3.5 inches so the resultant shape will be essentially constant for over 240° and of an increased radius over a range of 60° to 120°. Thus the final shape can be of a distorted circle having a small section of increased radius and the rest being of a generally uniform radius as illustrated in FIG. 14 and labelled 121. Because the increased radius takes away room that might otherwise be used for locating wires, sensors, etc., as best illustrated in FIG. 5, orbiting scroll 21 is provided with the nominal 3.5 inch radius and with an area of increased radius over a nominal 90°. Additionally, in the diagonally opposite section material is removed to reduce friction and provide more room as noted above. The diagonally opposite location is preferred for ease of balancing but the reduced radius portion may be located elsewhere, if required.

Although a preferred embodiment of the present invention has been illustrated and described, other modifications will occur to those skilled in the art. It is therefore intended that the present invention is to be limited only by the scope of the appended claims.

What is claimed is:

1. An orbiting scroll of a scroll machine having an axis, a plate and a spiral wrap extending from said plate with said plate having a varying radius relative to said axis wherein said radius is uniform for two segments totalling at least 180° with said two segments being separated by two generally diametrically located segments one of which is of a greater radius than said uniform segments and the other of which is of a lesser radius than said uniform segments.

2. In a scroll machine having a first and second scroll member with said second scroll member being adapted to be driven in an orbiting motion with respect to said first scroll member whereby said first and second scroll members coact in a compression process to compresses a gas with said gas producing gas forces responsive to said compression process with said gas forces including an axial gas force acting on said first and second scroll members and tending to cause their separation and a tangential gas force resisting driving of said second scroll member, said second scroll member having an axis, a plate having a first and second side, a spiral wrap extending from said first side, a hub extending from said second side and being supported by a bearing, means for applying an axial compliant force to said second side, said plate having a varying radius, r, which varies relative to said axis according to the relationship $$r = (F_{gt} l)/(F_p - F_{ga})$$

where $F_{gt}$ is the tangential gas force, l is the axial distance between the location of the tangential gas force and the opposed bearing reaction force, $F_p$ is the axial compliant force, and $F_{ga}$ is the axial gas force.

3. For a scroll machine having a first and second scroll member with said second scroll member being adapted to be driven by rotating crankshaft means while held to an orbiting motion with respect to said first scroll member whereby said first and second scroll members coact in a compression process extending over a plurality of revolutions of said crankshaft means to compress a gas with said gas producing gas forces responsive to said compression process with said gas forces including an axial gas force acting on said first and second scroll members and tending to cause their separation and a tangential gas force resisting driving of said second scroll member, compression process taking place in an operating envelope defining an entire range of allowable design operating conditions, a method for optimizing the circumferential shape of said second scroll member where said second scroll member has an axis, a floor portion having a first and second side, a spiral wrap extending from said first side, a hub extending from said second side and being supported with respect to said crankshaft means by a bearing, means for applying an axial compliant force to said second side, said floor portion having a constant reference radius, R, relative to said axis given said entire operating envelope comprising of the steps of:

determining the magnitudes of the tangential gas force, $F_{gt}$, the axial gas force, $F_{ga}$, and the axial compliant force, $F_p$, for each point in the operating envelope;

considering all crank angles relative to a revolution of said crankshaft, determining a crank angle dependent radius, r, relative to said axis according to the relationship $$r=(F_{gt}l)/(F_p-F_{ga})$$

where l is the axial distance between the location of the tangential gas force and the opposed bearing reaction force;

assigning a safety distance $\delta$; and changing R such that $R-r \geqq \delta$ for all crank angles at each intended operating condition.

4. The method of claim 3 further including the step of smoothing the shape of said floor portion resulting from changing R.

5. The method of claim 3 wherein R is changed only where it is increased.

6. The method of claim 3 wherein R is changed only where it is increased and at a generally diametrically located region where it is decreased.

* * * * *